US006007371A

United States Patent [19]

Hickox

[11] Patent Number: 6,007,371

[45] Date of Patent: Dec. 28, 1999

[54] FOLD FLEX ELECTRICAL CONNECTOR

[75] Inventor: Jeffrey Michael Hickox, Middlefield, Ohio

[73] Assignee: General Motors Corporation, Detroit, Mich.

[21] Appl. No.: 09/081,902

[22] Filed: May 20, 1998

[51] Int. Cl.[6] ..... H01R 9/07

[52] U.S. Cl. ..... 439/499; 439/77; 439/498

[58] Field of Search ..... 439/499, 498, 439/492, 67, 77, 712, 717, 701

[56] References Cited

U.S. PATENT DOCUMENTS

| | | | |
|---|---|---|---|
| 3,633,189 | 1/1972 | Billawala | 439/77 |
| 3,805,213 | 4/1974 | Austin | 439/77 |
| 5,651,694 | 7/1997 | Miyasaka et al. | 439/77 |
| 5,899,758 | 5/1999 | Yamamoto et al. | 439/77 |

FOREIGN PATENT DOCUMENTS

| | | | |
|---|---|---|---|
| 404206374 | 7/1992 | Japan | 439/492 |
| 22 03 905 | 10/1988 | United Kingdom | 439/429 |

*Primary Examiner*—Paula Bradley
*Assistant Examiner*—Tho D. Ta
*Attorney, Agent, or Firm*—Patrick M. Griffin

[57] ABSTRACT

An electrical connector includes a molded plastic connector body, a flexible printed circuit, a plurality of plastic cable trays, an elastomeric pad and a molded plastic cap. The flexible printed circuit includes a main section and two side sections that are attached to respective longitudinal sides of the main section by flexible webs. A plastic cable tray is attached at a rearward end of each section. Thin copper conductors are arrayed in the flexible printed circuit so that each copper conductor is attached to a raised feature pressure contact in a forward contact portion of the main section of the flexible printed circuit at one end and disposed in a cable channel of one of the plastic cable trays at the other end. Electric cable ends are secured in the cable channels and electrically connected to exposed contact pads of the copper conductors. A first side section is folded over the main section with its cable tray stacked on the top of the cable tray of the main section. The second side section is folded over the first side section with its plastic tray stacked on top of the plastic tray of the first side section. The folded subassembly is disposed in the connector body with the forward contact portion of the main section folded over the elastomeric pad which lies against the front wall of the connector body. The plastic cap is attached to the front of the connector body with the raised feature pressure contacts exposed in an opening in the face of the cap.

18 Claims, 4 Drawing Sheets

FOLD FLEX ELECTRICAL CONNECTOR

TECHNICAL FIELD

This invention relates generally to electrical connectors and more particularly to high density electrical connectors.

BACKGROUND OF THE INVENTION

As automotive wiring becomes more complex, there is continual pressure to reduce electric cable and electrical connector sizes. Connector contact areas can be reduced by use of well known gold dot contacts that are arranged in a closely spaced, high density array on a printed circuit. For instance, thirty-six (36) gold dot contacts one millimeter (1.0 mm) in size can be arranged on two millimeter (2.0 mm) centerlines in three rows of twelve contacts each resulting in an electrical connector having a foot print of about 33.8 mm by 11.7 mm at the gold dot contact end.

In order to take advantage of the size reduction and compact arrangement of the gold dot contact array, present proposals use very small electric cable in the thirty (30) gauge size range for the electrical connector. Such small electric cable sizes are difficult to work with and attach to the contact pads of the printed circuit particularly in high volume production. Consequently, there is a need for an electrical connector that has a high density array of gold dot contacts on a printed circuit that can be used with larger electric cable, for instance, cable in the twenty-four (24) gauge size range.

SUMMARY OF THE INVENTION

The object of this invention is to provide a small compact electrical connector that has a high density array of raised feature pressure contacts on a printed circuit while permitting the use of larger size electric cable.

A feature of the invention is that the electrical connector incorporates the high density array of raised feature pressure contacts on a flexible printed circuit.

Another feature of the invention is that the electrical connector incorporates a flexible printed circuit that is folded to take advantage of the size reduction of the high density array of raised feature pressure contacts while permitting the use of larger size electrical cable.

Another feature of the invention is that the electrical connector incorporates a foldable flexible printed circuit having a plurality of sections that each carry a cable tray for attaching electric cables to the flexible printed circuit.

Still another feature of the invention is that the electrical connector incorporates a flexible printed circuit that has a plurality of sections equipped with individual cable trays that are designed to facilitate attachment of the electric cables to the contact pads of the flexible printed circuit.

Yet another feature of the invention is that the electrical connector incorporates a flexible printed circuit that has a plurality of sections equipped with individual cable trays that are designed for accepting an ultrasonic welding horn and anvil to facilitate ultrasonic welding of the electric cables to the contact pads of the flexible printed circuit.

Still yet another feature of the invention is that the electrical connector incorporates a flexible printed circuit having several sections that are folded in a manner that facilitates attachment of electric cables to individual cable trays attached to each section.

These and other objects, features and advantages of the invention will become more apparent from the following description of a preferred embodiment taken in conjunction with the accompanying drawing.

DESCRIPTION OF THE PREFERRED EMBODIMENT

Figure 1:
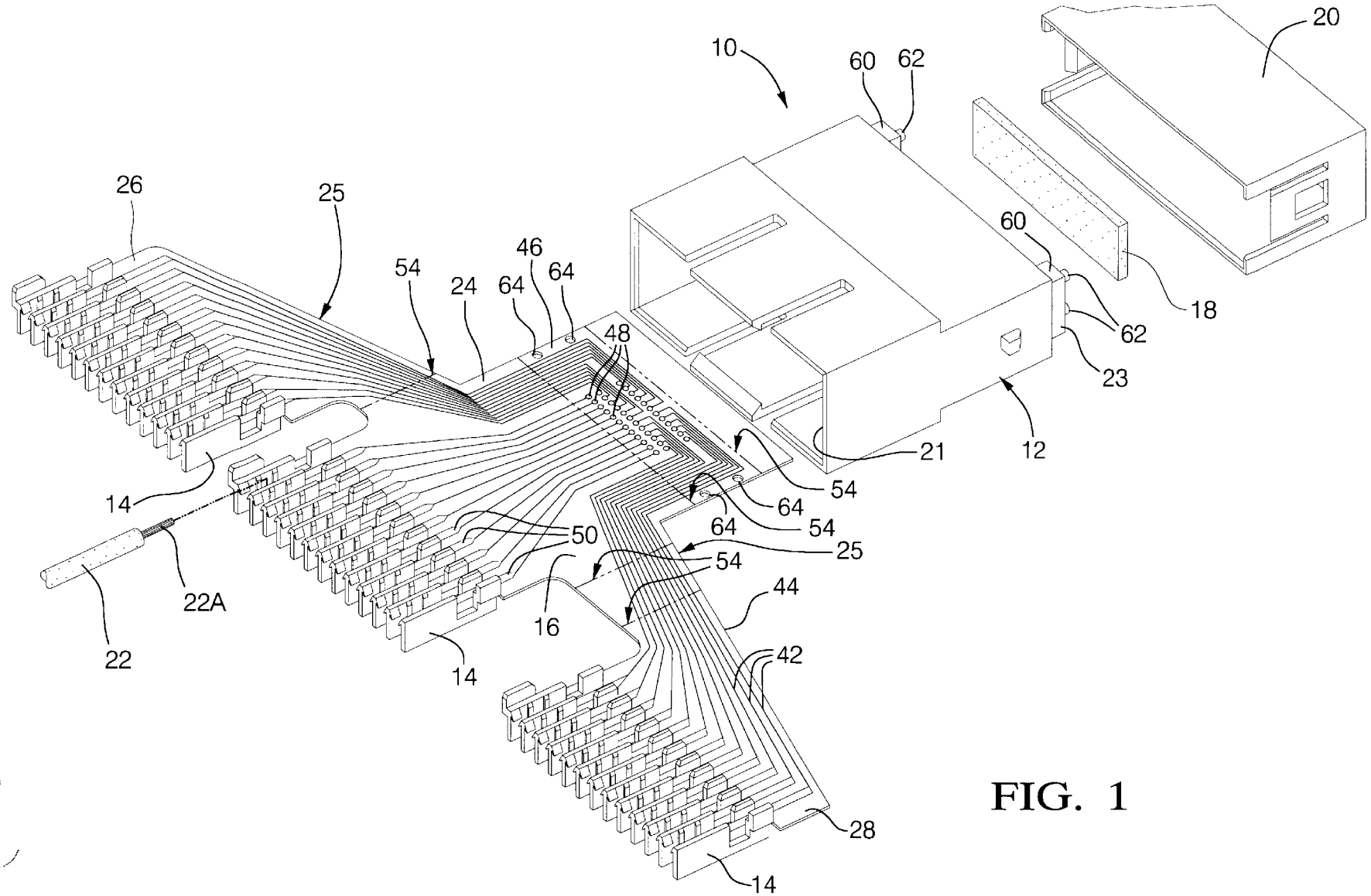
FIG. 1 is an exploded, perspective view of a fold flex electrical connector of the invention shown in a cable attachment stage.

Referring now to FIG. 1, a fold flex electrical connector 10 of the invention comprises a molded plastic connector body 12, a plurality of plastic cable trays 14, a flexible printed circuit 16, an elastomeric pad 18 and a molded plastic cap 20.

Figure 3:
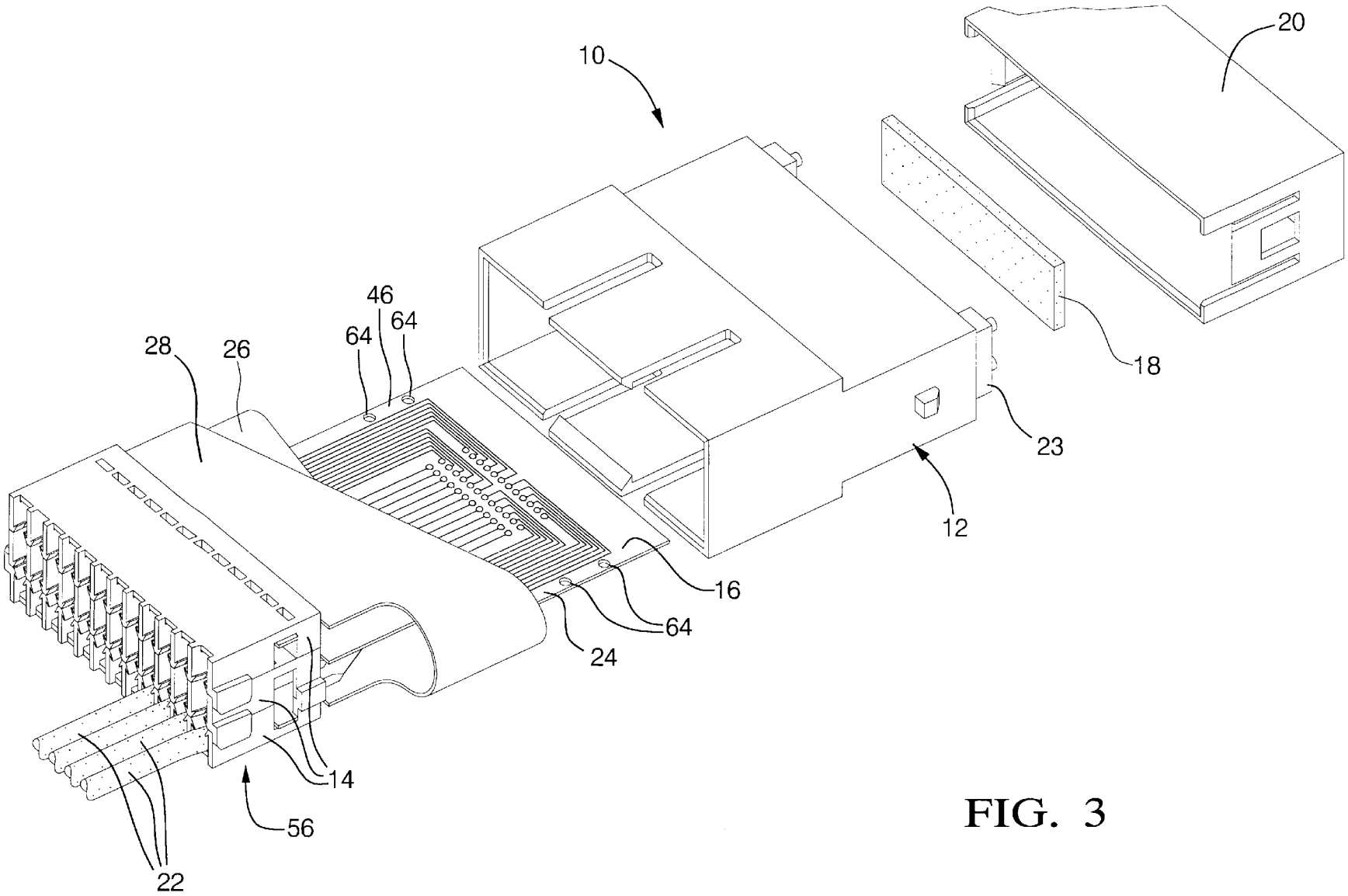
FIG. 3 is an exploded perspective rear view of the fold flex electrical connector of FIG. 1 shown in a later assembly stage.

Connector body 12 is a hollow, box-like structure that has a rear opening 21 for receiving the flexible printed circuit 16 with plastic trays 14 and electric cables 22 attached and folded as shown in FIG. 3 and a slotted front wall 23 for positioning a forward contact portion 46 of the flexible printed circuit 16 as explained in detail below.

Figure 2:
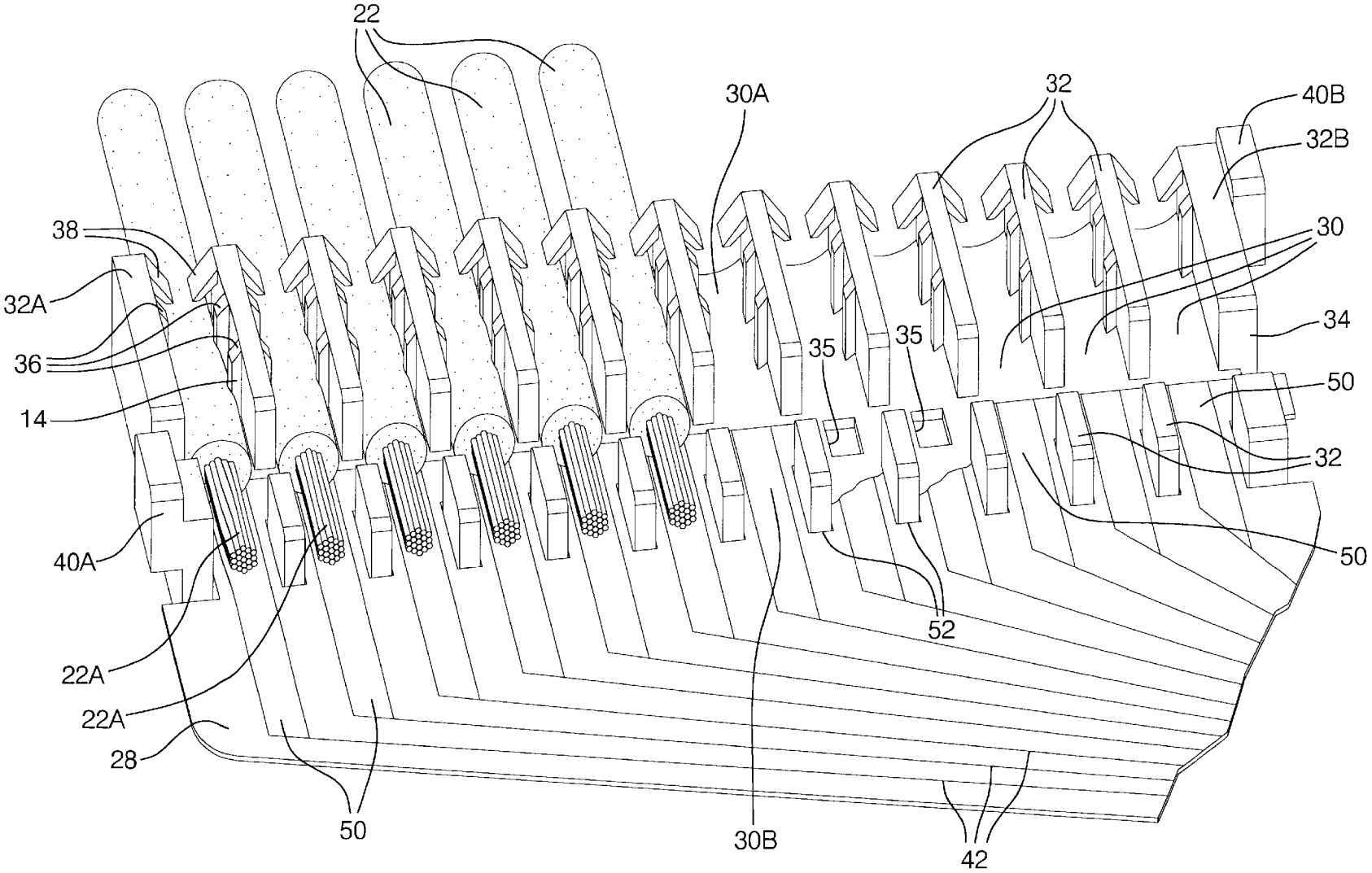
FIG. 2 is an enlarged perspective view showing the attachment of the electric cables to the flexible printed circuit.
Figure 4:
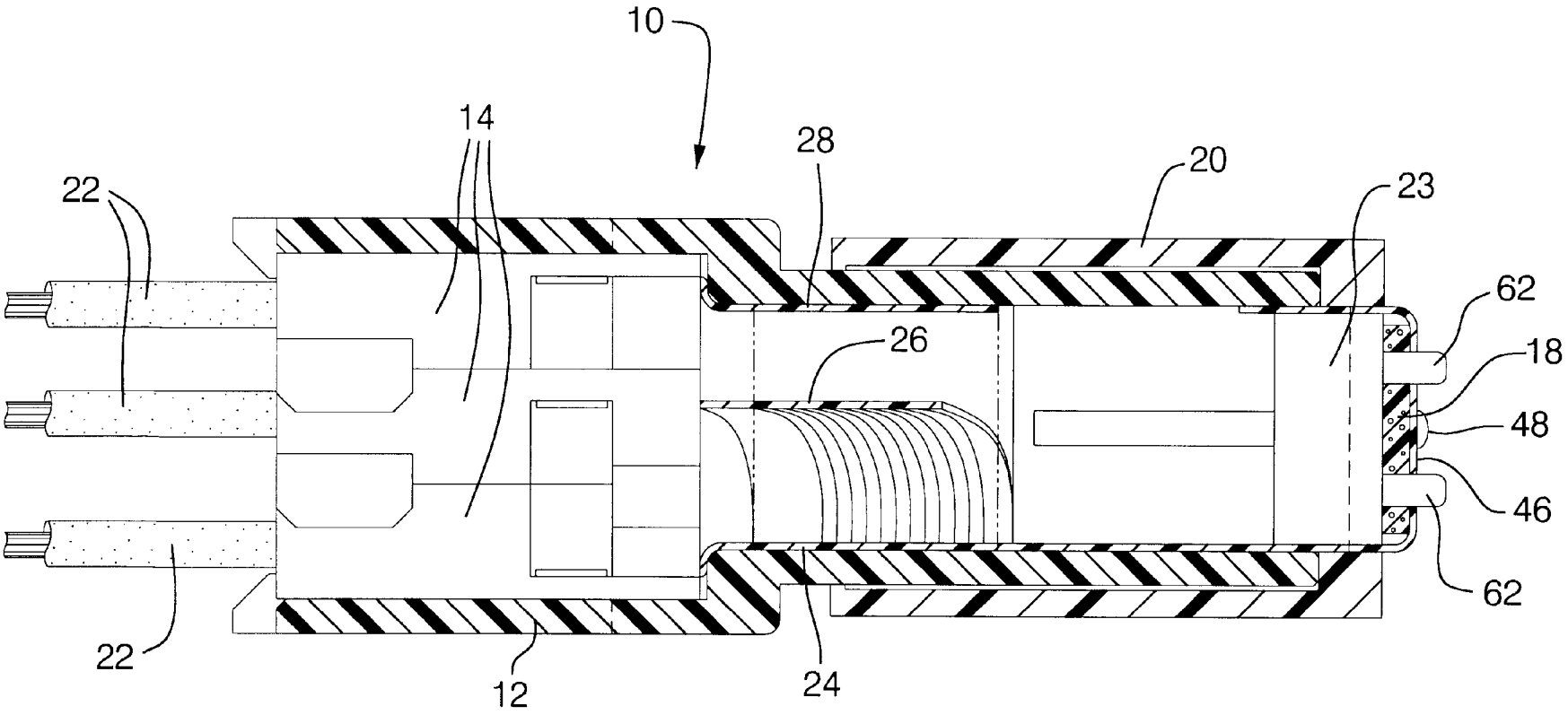
FIG. 4 is a longitudinal section of the fold flex electrical connector of FIG. 1 after assembly has been completed.

The flexible printed circuit 16 includes a main section 24 and two side sections 26 and 28 that are attached to the respective longitudinal side edges of the main section 24 by flexible web portions 25. The plastic cable tray 14 is attached to a rearward end of each section 24, 26 and 28. As best shown in FIG. 2, each plastic cable tray 14 includes a plurality of cable channels 30 defined by laterally spaced side walls 32 that are divided by a lateral slot 34 to define rearward cable insulation receiving portions 30A and forward cable core receiving portions 30B. Lateral slot 34 communicates with individual slots 35 in the base of cable tray 14 that are aligned with the cable channels 30. Cable insulation receiving portions 30A include strain relief ribs 36 that dig into the cable insulation to provide strain relief and flexible fingers 38 that hold ends of electric cables 22 in channels 30. Side walls 32 include outer or end walls 32A and 32B that have external tabs 40A and 40B respectively. Tabs 40A and 40B are at opposite ends of the outer walls 32*a* and 32B, that is tab 40A is at the forward end of the left hand end wall 32A shown in FIG. 3 while tab 40B is at the rearward end of the right hand end wall 32B. Lateral slot 34 and channel slots 35 facilitate making electrical connections between the conductive cores 22A of electric cables 22 and the flexible printed circuit 16. Tabs 40A and 40B facilitate stacking the three plastic trays 14 on top of each other as shown in FIGS. 3 and 4.

Flexible printed circuit 16 is shown schematically and represents a laminate that comprises a plurality of thin conductors 42 of copper or other suitable conductive material that are sandwiched between two flexible plastic sheets 44 of an electric insulation material and that is well known in the art.

The thin conductors 42 are arrayed so that each conductor 42 has one end in a forward contact portion 46 of main section 24 where one end is attached to a raised feature pressure contact 48 and an opposite end that terminates in a contact pad 50 at the rearward end of one of the sections 24, 26 or 28 as best shown in FIG. 2. Raised feature pressure contacts 48 are well known in the art and extend through the contact portion of flexible printed circuit 16 to provide a raised hemispherical or dot pressure contact 48 that protrudes from the lower surface of the flexible printed circuit 16 as viewed in FIGS. 1, 2 and 3. The raised feature pressure contact 48 is used to make electrical contact with another electrical contact surface which preferably is a relatively flat contact pad. Contact pads 50 are exposed at the upper surface of the flexible printed circuit 16.

The rearward portions of the three sections 24, 26 and 28 of the flexible printed circuit 16 each have a plurality of slots 52 between the exposed contact pads 50. Slots 52 receive the forward portions of side walls 32 for attaching flexible printed circuit 16 to the cable trays 14 and locating contact pads 50 in the lateral slot 34 and the forward cable core receiving portions 30*b* of the cable channels 30 as best shown in FIG. 2.

After individual cable trays 14 are attached to the rear end portions of the flexible printed circuit sections 24, 26 and 28, the ends of electric cables 22 are inserted into the individual cable channels 30 and held in place by strain relief ribs 36 and flexible fingers 38 in the rearward portions of cable channels 30. The conductive cores 22A in the lateral slot 34 and the forward portions 30*b* are then electrically connected to the contact pads 50, preferably by ultrasonic welding. The cable trays 14 are designed to provide access for the welder horn and mandrel by incorporating lateral slot 34 for a bar shaped horn and including slots 35 for a comb shaped mandrel.

After electric cables 22 are mechanically attached to cable trays 14 and electrically connected to the flexible printed circuit 16, side section 26 is folded over main section 24 and the tray 14 attached to the rearward end of side section 26 is stacked upside down on top of the tray 14 that is attached to the rearward end of main section 24. Side section 28 is then folded over side section 26 with its tray 14 stacked upside down on the bottom of the upside down tray 14 attached to the rearward end of side section 26 as shown in FIG. 4. The flexible webs that connect the side sections 26 and 28 to main section 24 may include fold lines 54 as shown in FIG. 1 to facilitate the folding process. Fold lines 54 may also be included in the forward portion of main section 24 to facilitate a further folding process described below.

After the side sections 26 and 28 are folded over, the folded subassembly 56, shown in FIG. 3, is inserted into the rear opening 21 connector body 12 until the forward portion of main section 24 projects through a slot in the bottom of the front wall 23 of the connector body 14 and the stacked trays are retained in the rearward portion of the connector body 12 as shown in FIG. 4. Front wall 23 has a cavity for holding elastomeric pad 18 and side bosses 60 that have projecting posts 62. The forward projecting portion of the main section 24 of the flexible printed circuit 16 is folded upright over the elastomeric pad 18 and then folded back and inserted into a second slot in the top of the front wall 23 so that the forward contact portion 46 overlies the elastomeric pad 18 with the raised feature pressure contacts 48 facing forward as shown in FIG. 4. The forward contact portion 46 is held in position by posts 62 engaging in holes 64 in the forward contact portion 46 of the flexible printed circuit 16.

The molded plastic cap 20 is then attached to the front end of connector body 16 so that the contact portion is exposed by an opening in the face of the cap 20 as shown in FIG. 4.

While I have shown a flexible printed circuit 16 having a main section 24 and two side sections 26, 28 with three stackable cable tray 14, other configurations are also possible depending upon the number of the electric cables 22 that need to be connected by the fold flex electrical connector 12 and the space that is available. For instance a single side section with two stacked cable trays might be used where a thinner and wider connector is desired or two side sections on each side of a main section with five stacked cable trays might be used where a very large number of electrical cables need to be connected.

Obviously, many modifications and variations of the present invention in light of the above teachings may be made. It is, therefore, to be understood that, within the scope of the appended claims, the invention may be practiced otherwise than as specifically described.

I claim:

1. An electrical connector comprising:

a molded plastic connector body, a plurality of plastic cable trays and a flexible printed circuit, the connector body having a rear opening and a front wall, the flexible printed circuit including a main section and at least one side section that is attached to a longitudinal side of the main section by a flexible web, the main section and the side section each having one of the cable trays attached to a rearward end wherein the one of the cable trays includes a plurality of cable channels, the flexible printed circuit having a plurality of thin conductors that are arrayed so that each conductor is attached to a gold dot contact located in a forward contact portion of the main section of the flexible printed circuit and an exposed contact pad that is disposed in one of the cable channels of the cable trays, the side section being folded over the main section so that their respective cable trays are stacked one on top of the other to form a folded subassembly, and the folded subassembly being disposed in the connector body with the forward contact portion folded into an upright position in front of the front wall of the connector body with the gold dot contacts facing forward.

2. The electrical connector as defined in claim 1 further including a cap that is attached to a forward end of the connector body for retaining the flexible printed circuit.

3. The electrical connector as defined in claim 1 further including an elastomeric pad that is disposed between the front wall of the connector body and the forward contact portion of the flexible printed circuit.

4. The electrical connector as defined in claim 1 wherein the flexible web includes a fold line to facilitate folding of the side section over the main section.

5. The electrical connector as defined in claim 1 wherein the main section of the flexible printed circuit includes a forward portion that includes the forward contact portion and that extends through a lower slot in the front wall of the connector body and back through an upper slot in the front wall.

6. The electrical connector as defined in claim 1 wherein the cable channels are defined by laterally spaced side walls that include strain relief ribs and flexible fingers for holding electric cables in the cable channels.

7. The electrical connector as defined in claim 6 the side walls include outer walls that have external tabs for facilitating the stacking of the cable trays one on top of another.

8. The electrical connector as defined in claim 6 wherein the side walls are divided by a lateral slot and the cable channels have slots communicating with the lateral slot for facilitating electrical connection of the electric cables to the contact pads of the flexible printed circuit by ultrasonic welding.

9. The electrical connector as defined in claim 1 wherein the flexible printed circuit includes a second side section that is attached to an opposite longitudinal side of the main section by a second flexible web and that is folded over the at least one side section wherein the at least one side section is a first side section with its cable tray stacked on top of the cable tray that is attached to the second section.

10. The electrical connector as defined in claim 9 wherein the cable tray that is attached to the first side section is stacked upside down on the top of the cable tray that is attached to the main section and the cable tray that is attached to the second side section is stacked upside down on the bottom of the cable tray that is attached to the first side section.

11. An electrical connector comprising:

a molded plastic connector body, a plurality of plastic cable trays and a flexible printed circuit, the connector body having a rear opening and a front wall, the flexible printed circuit including a main section, a first side section that is attached to a longitudinal side of the main section by a first flexible web, and a second side section that is attached to an opposite longitudinal side of the main section by a second flexible web, the main section, the first side section and the second side section each having a cable tray attached to a rearward end that includes a plurality of cable channels, the flexible printed circuit having a plurality of thin conductors that are arrayed so that each conductor is attached to a raised feature pressure contact located in a forward contact portion of the main section of the flexible printed circuit and an exposed contact pad that is disposed in one of the cable channels of the cable trays, the first side section and the second side section being folded so that the cable trays of the main section, the first side section and the second side section are stacked one on top of the other to form a folded subassembly, and the folded subassembly being disposed in the connector body with the forward contact portion folded into an upright position in front of the front wall of the connector body with the raised feature pressure contacts facing forward.

12. The electrical connector as defined in claim 11 further including an elastomeric pad that is disposed between the front wall of the connector body and the forward contact portion of the flexible circuit, and a cap that is attached to a forward end of the connector body, the cap having an opening exposing the raised feature pressure contacts.

13. The electrical connector as defined in claim 12 wherein the cable channels are defined by laterally spaced side walls that include strain relief ribs and flexible fingers for holding electric cables in the cable channels.

14. The electrical connector as defined in claim 12 wherein the side walls include outer walls that have external tabs for facilitating the stacking of the cable trays one on top of another.

15. The electrical connector as defined in claim 12 wherein the side walls are divided by a lateral slot for facilitating electrical connection of the electric cables to the contact pads of the flexible printed circuit.

16. The electrical connector as defined in claim 12 wherein the main section of the flexible printed circuit includes a forward portion that includes the forward contact portion and that extends through a lower slot in the front wall of the connector body and back through an upper slot in the front wall.

17. The electrical connector as defined in claim 16 wherein the flexible webs include fold lines to facilitate folding of the side sections with respect to the main section and the forward portion includes fold lines for folding the forward contact portion against the elastomeric pad and back through the upper slot.

18. The electrical connector as defined in claim 16 wherein the cable tray that is attached to the first side section is stacked upside down on the top of the cable tray that is attached to the main section and the cable tray that is attached to the second side section is stacked upside down on the bottom of the cable tray that is attached to the first side section.

* * * * *